US005941777A

United States Patent [19]

Moser et al.

[11] Patent Number: 5,941,777

[45] Date of Patent: Aug. 24, 1999

[54] PERFECTED AMUSEMENT RIDE

[75] Inventors: Alfeo Moser; Claudio Soriani, both of Melara, Italy

[73] Assignee: Soriani & Moser Manufacturers of Amusement Rides S.r.L., Melara, Italy

[21] Appl. No.: 08/562,446

[22] Filed: Nov. 24, 1995

[30] Foreign Application Priority Data

Nov. 29, 1994 [IT] Italy ..... BO940199 U

[51] Int. Cl.[6] ..... A63G 31/08

[52] U.S. Cl. ..... 472/44; 472/46

[58] Field of Search ..... 472/3, 44, 45, 472/46, 130, 47, 1

[56] References Cited

U.S. PATENT DOCUMENTS 4,643,416 2/1987 van der Veen ..... 472/45

4,807,869 2/1989 Knijpstra ..... 472/45

5,188,566 2/1993 Böhme ..... 472/45

5,314,383 5/1994 Fabbri ..... 472/45

*Primary Examiner*—Kien T. Nguyen

*Attorney, Agent, or Firm*—Royston, Rayzor, Vickery, Novak & Druce, L.L.P.

[57] ABSTRACT

An amusement ride presenting a platform; two parallel vertical uprights extending upwards from the platform; two arms fitted to respective uprights and rotated by drive means about a first horizontal axis; and a passenger car fitted to the arms and rotating about a second axis; characterized in that the car presents a supporting structure, and three rows of seats fitted to the structure and all facing in the same direction.

10 Claims, 2 Drawing Sheets

PERFECTED AMUSEMENT RIDE

BACKGROUND OF THE INVENTION

The present invention relates to a perfected amusement ride featuring a novel passenger car.

Patent EP 433557 relates to an amusement ride comprising:

a platform;

two vertical uprights fitted to the platform;

two arms, each fitted to a respective upright and formed in one piece, and both rotating about a horizontal axis; and a passenger car fitted to said arms.

The passenger car in the above patent presents a terraced supporting structure with two surfaces at different levels; a row of seats extards along each surface; and the axis of rotation of the car is some distance from its barycenter.

The above car presents several drawbacks, in particular the complex design of the supporting structure, the limited seating capacity of the car, and the considerable force required to effect a full turn of the car about its rotation axis.

SUMMARY OF THE INVENTION

It is an object of the present invention to provide a perfected amusement ride featuring a passenger car of straightforward design, with a large seating capacity, and which requires very little force to effect a full turn about its rotation axis.

According to the present invention, there is provided an amusement ride comprising:

a platform;

two parallel vertical uprights extending upwards from the platform;

two arms fitted to respective said uprights and rotated by drive means about a first horizontal axis;

a passenger car fitted to said arms and rotating about a second axis;

characterized in that the car comprises a supporting structure; and three rows of seats fitted to said structure and facing crosswise to said second axis.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
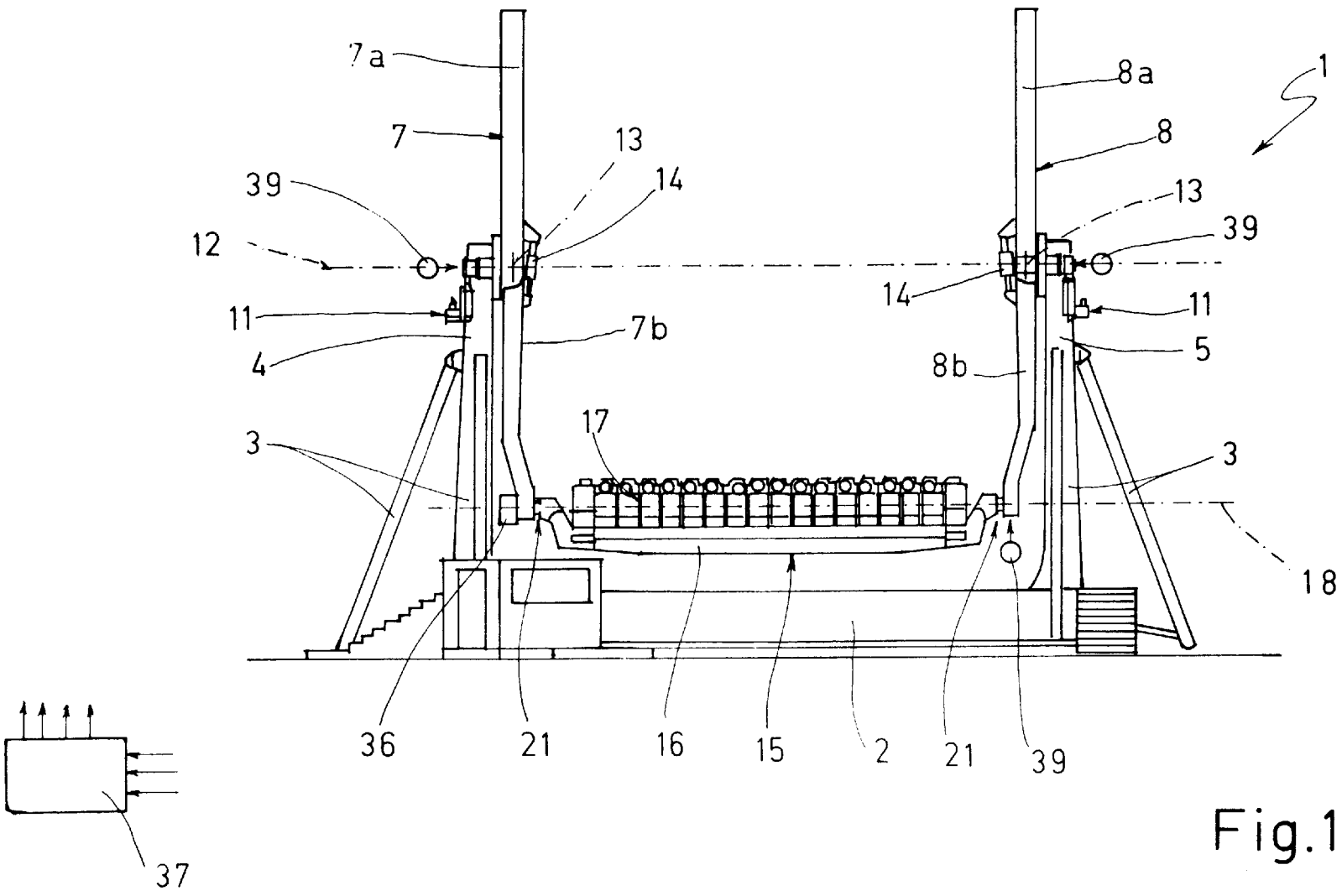
FIG. 1 show n a side view of an amusement ride in accordance with the teachings of the present invention.

Number 1 in FIG. 1 indicates an amusement ride comprising a platform 2 secured to the ground by a number of ties 3; and two parallel vertical uprights 4, 5 extending upwards from opposite axial ends of platform 2. More specifically, ties 3 secure platform 2 by connecting uprights 4 and 5 to the ground; and platform 2 may present a number of wheels for transporting ride As shown in FIG. 1, uprights 4 and 5 are fitted at the top and with respective arms 7 and 8 rotated by respective known drive means 11 about a horizontal axis 12. Each arm 7, 8 comprises a respective portion 7*a*, 8*a* pivoting on the top and of respective upright 4, 5 and which may therefore only rotate about axis 12; and a respective portion 7*b*, 8*b* hinged to and rotatable with respective portion 7*a*, 8*a* about axis 12, and which may be rotated about its hinge axis 13 by a respective hydraulic actuator 14 fitted to portion 7*a*, 8*a* and presenting a sliding rod hinged at one and to portion 7*b*, 8*b*.

Figure 2:
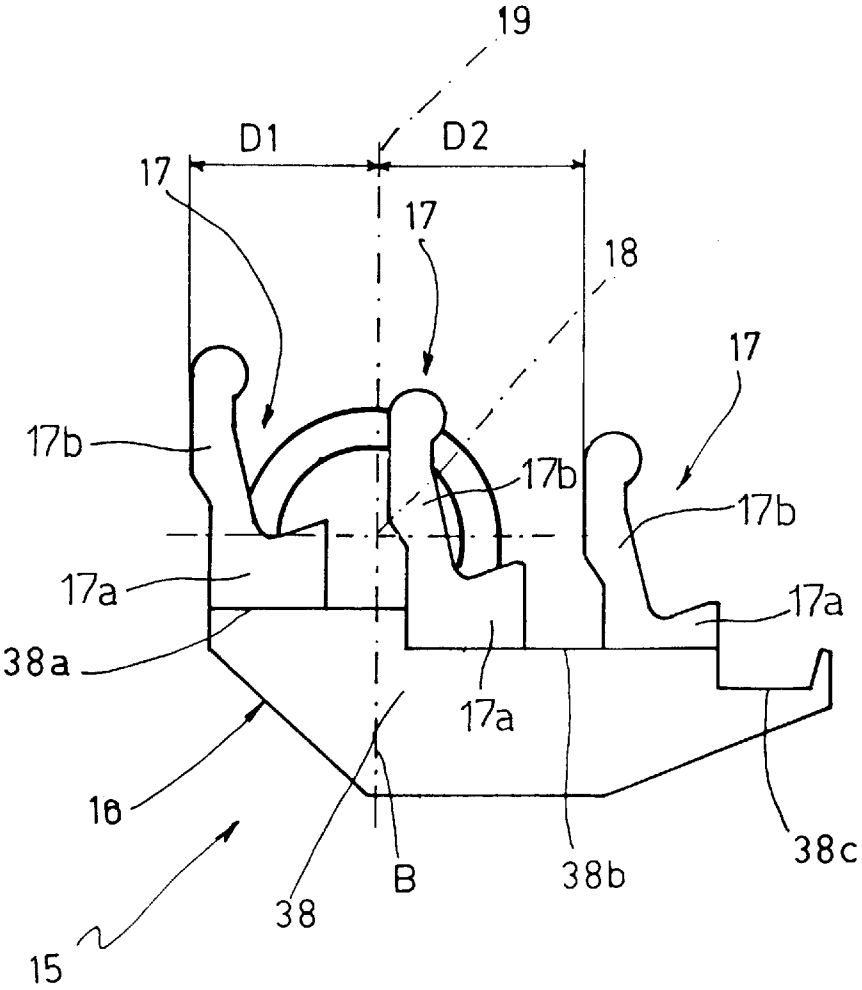
FIG. 2 shows a side view of a passenger car of the FIG. 1 ride.

As shown in FIGS. 1 and 2, ride 1 comprises a passenger car 15 presenting a supporting structure 16, and three rows 17 of seats fitted to structure 16 and facing in the same horizontal direction crosswise to a rotation axis 18. Car 15 is fitted to arms 7 and 8, and in particular to portions 7*b* and 8*b*. More specifically, along axis 18, structure 16 presents two articulated joints 21 by which it is connected to the free ends of portions 7*b* and 8*b*, and by which it is permitted to rotate about axis 18 during operation of ride 1. Each joint 21 permits three degrees of freedom of car 15, and the joint 21 between portion 7*b* of arm 7 and the corresponding axial end of car 15 presents a known brake device 36, such as an Eaton Airflex 325DC Clutch.

As shown in FIG. 1, ride 1 also comprises an electronic control unit 37 for controlling drive means 11, actuators 14 and device 36, and to which are connected known sensors 39 for detecting the angle of rotation of arms 7 and 8 about axis 12 and of car 15 about axis 18.

As shown in FIG. 2, supporting structure 16 comprises a terraced dock 38 presenting in succession a flat surface 38*a* fitted with rear row 17, a flat central surface 38*b* at a lower level than surface 38*a* and fitted with central row 17 and front row 17, and a flat surface 38*a* at a lower level than surface 38*b* and for supporting the feet of the passengers in front row 17. The seat portions 17*a* of the seats in front row 17 are lower than those of the seats in the other rows 17; the backrests 17*b* of rows 17 are substantially perpendicular to respective surfaces 38*a* and 38*b*; the distance D1 between the headrest of the seats in rear row 17 and a straight vertical line 19 through axis 18 is less than the distance D2 between line 19 and the headrest of front row 17; and axis 18 is substantially on a level with the seat portions 17*a* of rear row 17.

In actual use, ride 1 provides for a number of operating cycles, including full rotation of car 15 about axis 18, both when axis 18 is horizontal and when it is inclined in relation to axis 12. The operating cycles of ride 1 are controlled by unit 37 which, by means of sensors 39, knows the angular position of both arms 7 and 8 and car 15 at all times.

The advantages of the present invention will be clear from the foregoing description.

In particular, it provides for a ride featuring a passenger car of straightforward design, with a large seating capacity, and which is therefore more profitable to operate. A further point to note is the advantageous position of axis 18 in relation to the component parts of car 15, which, by virtue of axis 18 being located, along line 19, close to the barycenter B (FIG. 2) of the car, is rotated fully with very little effort.

Clearly, changes may be made to ride 1 as described and illustrated herein without, however, departing from the scope of the present invention.

For example, the rows of seats 17 say be inclined.

We claim:

1. An amusement ride comprising:

two upwardly extending and substantially parallel vertical uprights;

two arms fitted to respective said uprights and rotatable by a drive about a first horizontal axis;

a passenger car axially attached to free ends of said arms and rotatable about a second axis extending between said arms in the axis of attachment of said car to said arms;

wherein said car comprises:

a supporting structure; and a rear row, a central row and a front row of seats fitted to said structure and facing crosswise to said second axis, wherein each said row comprises a seat portion having a backrest with a headrest;

wherein said supporting structure comprises a terraced deck presenting in succession a first flat surface fitted with said rear said row, a second flat surface at a lower level than said first surface and fitted with said central and said front said rows, and a third flat surface at a lower level than said second surface and for supporting the feet of the passengers in said front row; and wherein the radial distance between said second axis and the headrests of the seats of said rear row is less than the radial distance between said second axis and the headrests of the seats of said front row; and wherein said second axis is substantially on a level with the seat portions of the seats of said rear row.

2. A ride as claimed in claim 1, wherein said supporting structure comprises a terraced deck presenting in succession a first flat surface fitted with a rear said row, a second flat surface at a lower level than said first surface and fitted with a central and a front said row, and a third flat surface at a lower level than said second surface and for supporting the feet of the passengers in said front row.

3. A ride as claimed in claim 2, wherein a horizontal direction, the distance between said second axis and said rear row is less than the distance (D2) between said second axis and said front row said second axis being substantially on a level with the seat portions of said rear row.

4. A ride as claimed in claim 1, wherein the seat portions of the seats in said front row are lower than the seat portions of the seats in said central row.

5. A ride as claimed in claim 1, wherein said second axis is close to the barycenter of said car.

6. A ride as claimed in claim 5, said barycenter of said car lies along a straight line perpendicular to said second axis.

7. A ride as claimed in claim 1, wherein said seats all face in the same direction.

8. A ride as claimed in claim 7, wherein said direction is horizontal.

9. A ride as claimed in claim 1, wherein: each of said arms comprises:

a first portion pivotable relative to a respective said upright and rotatable only about said first axis, and a second portion hinged to and rotatable with the corresponding said first portion about said first axis and which is also rotatable about the hinge axis between said first portion and said second portion by an actuator; and said car is fitted to the free ends of said second portions.

10. An amusement ride, comprising:

two upwardly extending and substantially parallel vertical uprights;

two arms fitted to said uprights and rotatable by a drive about a first horizontal axis;

a passenger car axially attached to free ends of said arms and rotatable about a second axis extending between said arms in the axis of attachment of said car to said arms;

wherein said car comprises:

a supporting structure; and a rear row, a central row and a front row of seats fitted to said structure and facing crosswise to said second axis, wherein each said row comprises a seat portion having a backrest with a headrest;

wherein each of said arms comprises:

a first portion pivotable relative to a respective said upright and rotatable only about said first axis; and a second portion hinged to and rotatable with the corresponding said first portion about said first axis and which is rotatable about the hinge axis between said first portion and said second portion by an actuator;

wherein said car is fitted to the free ends of said second portions;

an electronic control unit for controlling said drive and said actuator; and sensors connected to said control unit for determining the angular position of said arms about said first axis and of said car about said second axis.

* * * * *